United States Patent [19]

Elliott et al.

[11] Patent Number: 5,060,626

[45] Date of Patent: Oct. 29, 1991

[54] COMPOUND BOW DRAW SENSOR

[76] Inventors: James P. Elliott, Rte. 1, Box 126B; Jerry A. Elliott, Rte. 1, Box 19M; Ted M. Elliott, Rte. 1, Box 18A1, all of Buchanan, Tenn. 38222

[21] Appl. No.: 617,014

[22] Filed: Nov. 19, 1990

[51] Int. Cl.[5] ..... F41B 5/00

[52] U.S. Cl. ..... 124/86; 124/23.1; 124/25.6; 124/900; 200/61.1

[58] Field of Search ..... 124/23.1, 24.1, 25.6, 124/86, 88, 90, 900; 33/265; 200/61.1, 61.13, 61.17, 61.18, 543, 544, 564, 570

[56] References Cited

U.S. PATENT DOCUMENTS

| | | | |
|---|---|---|---|
| 3,288,988 | 11/1966 | Boggs | 124/23.1 X |
| 3,867,920 | 2/1975 | Westphal | 124/24.1 |
| 4,134,383 | 1/1979 | Flood | 124/25.6 |
| 4,643,159 | 2/1987 | Ryan | 124/88 |
| 4,689,887 | 9/1987 | Colvin | 33/265 |
| 4,741,320 | 5/1988 | Wiard | 124/23.1 |
| 4,753,528 | 6/1988 | Hines et al. | 33/265 X |
| 4,813,150 | 3/1989 | Colvin | 33/265 |

*Primary Examiner*—Peter M. Cuomo
*Assistant Examiner*—John Ricci
*Attorney, Agent, or Firm*—Walker & McKenzie

[57] ABSTRACT

A sensor for use with a compound archery bow of the type including a body, a bowstring for being drawn by an archer, and a cam for connecting the bowstring to the body. The sensor includes a switch for being closed by the cam in response to the drawing of the bowstring; a light for emitting light when electrically energized and activated; and an electrical energy source for electrically energizing and activating the light when the switch is closed.

18 Claims, 3 Drawing Sheets

FIG. 11
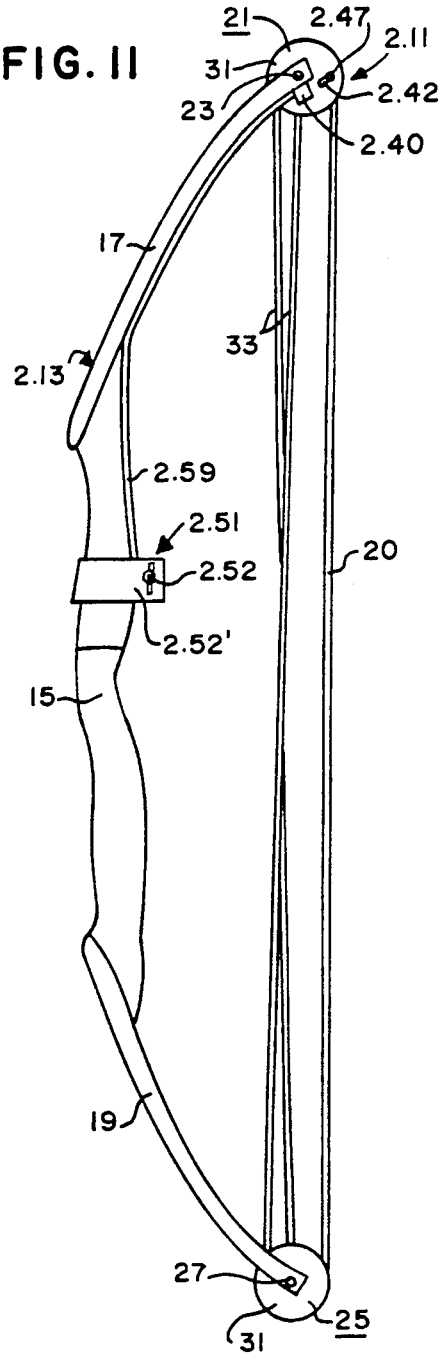
FIG. 12
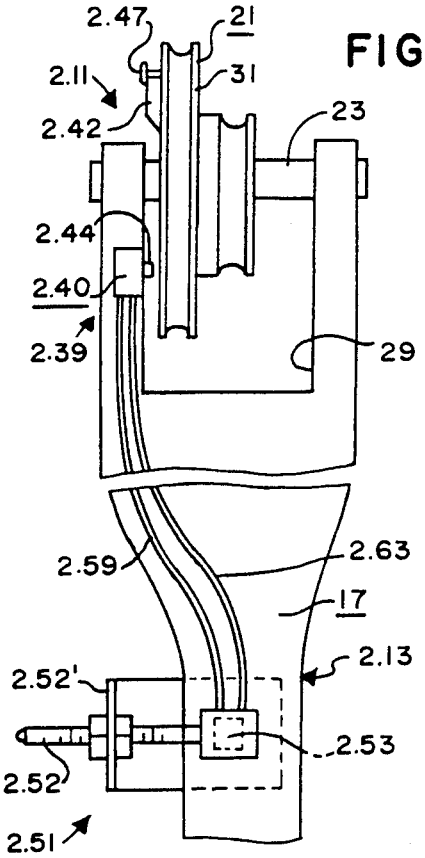
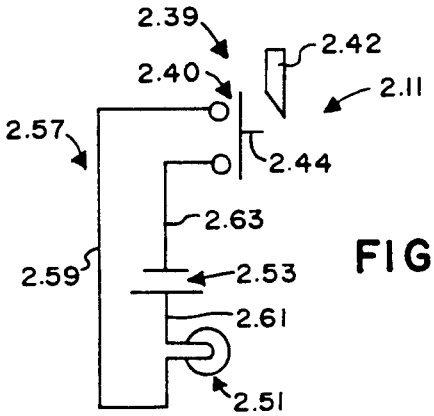
FIG. 13
FIG. 14
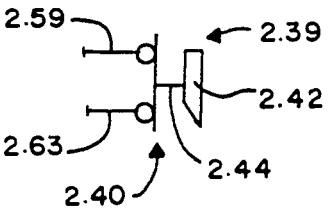

COMPOUND BOW DRAW SENSOR

BACKGROUND OF THE INVENTION

1. Field of the Invention

The present invention relates, in general, to a sensor for indicating when an archer using a compound bow has drawn his or her arrow to a preselected point.

2. Information Disclosure Statement

On modern compound hunting and target archery bows, an arrangement of cables and pulleys is used to reduce the amount of hold-back force the archer encounters. The accuracy of a bow shot is affected by the consistency of the amount of draw back of each successive shot. Thus, the desired aim of an archery bow is consistently achieved only if the arrow is drawn to a proper draw position. The inventors are aware of a small mechanical spring loaded clicker that rides atop the arrow shaft as the bowstring and arrow are brought back to a shooting position. As the arrow tip withdraws from beneath a finger of the clicker, the clicker springs down and sounds an audible click of the side of the bow handle to indicate that the arrow has been drawn to a certain draw position. Colvin, U.S. Pat. Nos. 4,689,887 and 4,813,150 disclose an archery sight that includes a light emitting sight pin, an electrical switch for selectively activating the light emitting sight pin, and an elongated cord extending from the switch to the bow string for closing the switch when the bow string has been drawn a predetermined distance to thereby activate the light emitting sight pin.

The prior art spring loaded clicker does not disclose or suggest the present invention. More specifically, nothing in the prior art discloses a sensor for use with a compound archery bow of the type including a body, a bowstring for being drawn by an archer, and cam means for connecting the bowstring to the body; the sensor including switch means for being closed by the cam means in response to the drawing of the bowstring; light means for emitting light when electrically energized and activated; and an electrical energy source for electrically energizing and activating the light means when the switch means is closed.

SUMMARY OF THE INVENTION

The present invention is directed toward providing an improved sensor for indicating when an archer using a compound bow has drawn his or her arrow to a preselected point. The concept of the present invention is to combine a light source with one of the pulleys of a compound bow in such a way that the light source will emit light when the bow has been drawn to a preselected point.

The sensor of the present invention is for use with a compound archery bow of the type including a body, a bowstring for being drawn by an archer, and cam means for connecting the bowstring to the body; and includes, in general, switch means for being closed by the cam means in response to the drawing of the bowstring; light means for emitting light when electrically energized and activated; and an electrical energy source for electrically energizing and activating the light means when the switch means is closed.

A primary objective of the present invention is to provide means for consistently and accurately indicating to an archer when the arrow on his or her bow is drawn to a preselected point.

BRIEF DESCRIPTION OF THE DRAWINGS

FIG. 11 is a side elevational view of a typical compound archery bow with a second embodiment of the sensor of the present invention combined therewith and with the bow in an undrawn position.

FIG. 12 is an enlarged end view of a portion of FIG. 11 with portions thereof broken away for clarity.

FIG. 13 is a somewhat diagrammatic electrical schematic of the electrical components of the second embodiment of the sensor of the present invention.

FIG. 14 is a somewhat diagrammatic view of a portion of FIG. 13 in a moved position.

BRIEF DESCRIPTION OF THE PRESENT INVENTION

As hereinabove discussed, modern compound hunting and target bows include an arrangement of cables and eccentric pulleys for reducing the amount of hold-back force the archer encounters. The sensor of the present invention includes an activating switch located at one of the pulleys of a typical compound bow. Choice as to which of the standard two pulleys should be used is unimportant as the concept will work equally well from either location.

As an arrow is drawn back for a shot, the pulleys at the ends of the bow limbs rotate utilizing their mechanical advantage to help flex the bow limbs. The activating switch of the sensor of the present invention includes a contact plate affixed to one of the rotating pulleys. The contact plate can be freely adjusted by hand and then locked into place by a lock screw when in the desired position. The activating switch of the sensor includes a portion firmly fixed on one of the bow limbs adjacent the rotating contact plate that includes switch contacts positioned in the path of the rotating contact plate. When the bow is drawn, the rotating contact plate will revolve with the pulley, pass under the switch contacts, and come to bear on the switch contacts. The switch contacts are connected by wires to a small battery powered light source housed and insulated such that is necessary for electrical current to pass through the switch contacts and rotating contact plate before energizing the light source. Thus, as the bow is drawn, the rotating contact plate revolves to bring a conducting surface to bear on the switch contacts and to thereby energize the light source By tailoring the width of the rotating contact plate, the length of time the light source stays energized can be lengthened or shortened.

In use, the archer will draw the bow back to his or her preferred full draw position. An assistant would then release the locking screw on the rotating contact plate and position it so that the light source is energized and stays energized. The locking screw is then tightened and the bow can be returned to the relaxed position. As the bow is relaxed, the rotating contact plate will rotate with the pulley and remove its conducting strip from beneath the switch contacts, causing the light source to go out.

When the bow is redrawn, the rotating contact plate will once again rotate and bear on the switch contacts at the same preset position. If the bow is drawn too far, the conducting plate will rotate past the switch contacts and the light source will go out, indicating an overdrawn condition.

DETAILED DESCRIPTION OF THE PREFERRED EMBODIMENTS

A first preferred embodiment of the sensor of the present invention is shown in FIGS. 1–10 and identified by the numeral 11. The sensor 11 is for use with any typical compound archery bow 13 or the like.

Figure 1:
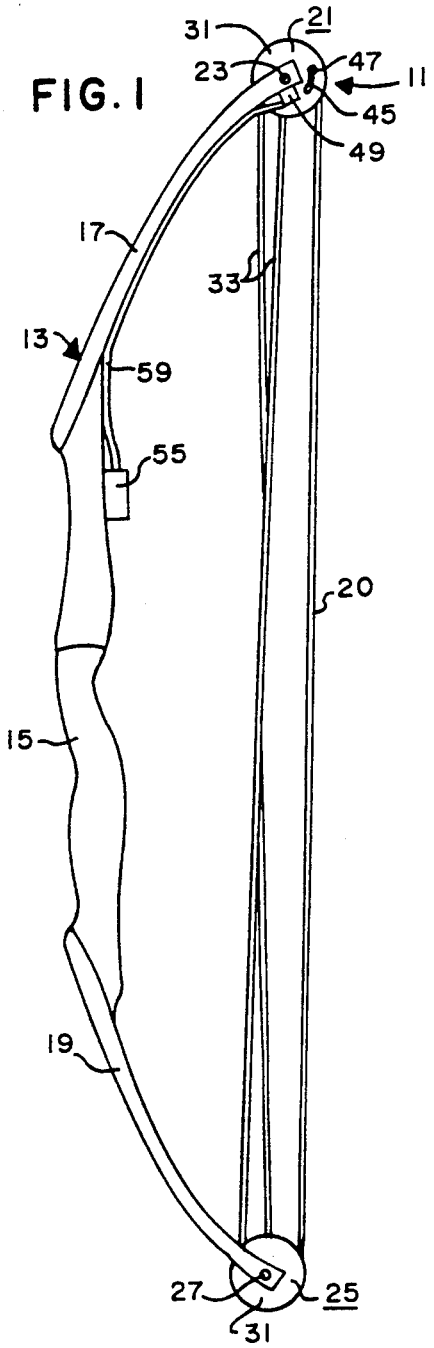
FIG. 1 is a side elevational view of a typical compound archery bow with a first embodiment of the sensor of the present invention combined therewith and with the bow in an undrawn position.
Figure 2:
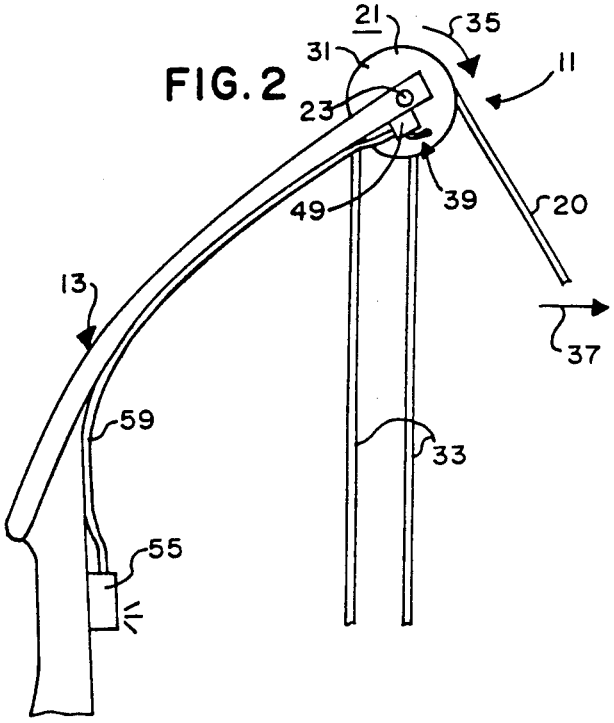
FIG. 2 is an enlarged view of a portion of FIG. 1 with the bow in a drawn position.
Figure 3:
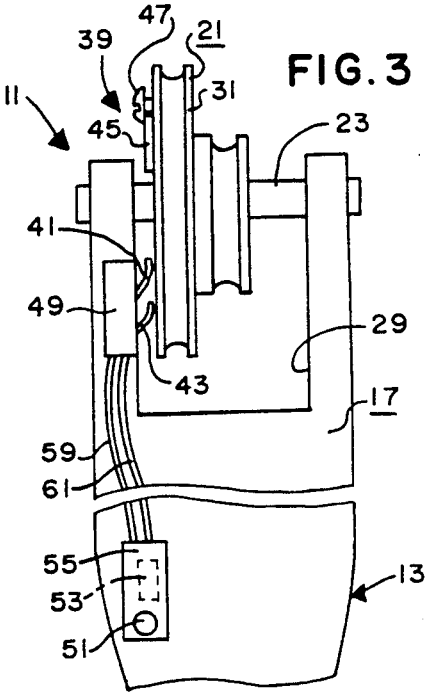
FIG. 3 is an enlarged end view of a portion of FIG. 1 with portions thereof broken away for clarity.

The archery bow 13 typically includes a body having a central handle section 15 from which extends an upper limb 17 and a lower limb 19. The handle section 15 may be constructed in various specific designs and out of any suitable material which is substantially rigid such as metal, wood, plastic, etc., as will now be apparent to those skilled in the art. The limbs 17, 19 may also be constructed in various designs and out of any suitable material which is somewhat flexible or resilient such as wood, plastic, etc., as will now be apparent to those skilled in the art. While it is common to construct the handle section 15 and limbs 17, 19 as separate elements as illustrated in FIGS. 1 and 2 with the limbs 17, 19 attached to the handle section 15 by screws or the like (not shown), it will be apparent to those skilled in the art that the handle section 15 and limbs 17, 19 may be constructed as a one-piece, integral unit. The archery bow 13 includes a bowstring 20 for being drawn by the archer, and includes cam means for connecting the bow string 20 to the body of the archery bow 13. The cam means preferably includes an upper cam means 21 mounted on the outer tip of the upper limb 17 by an axle member 23, and a lower cam means 25 mounted on the outer tip of the lower limb 19 by an axle member 27. The outer tip of each limb 17, 19 may have a slot 29 or the like for receiving the respective cam means 21, 25. On the other hand, the cam means 21, 28 may be mounted to the respective limbs 17, 19 by flanges, etc., as will now be apparent to those skilled in the art. Each cam means 21, 25 preferably includes a body 31 for being rotated when the bow string 20 is drawn. The bowstring 20 extends generally between the upper and lower cam means 21, 25. Tension cables 33 are preferably coupled to the opposite ends of the bowstring 20 and ar trained about the cam means 21, 25 in a manner so that the cam means 21, 25 will rotate as indicated by the arrow 35 in FIGS. 2, 8, and 10 when the bowstring 20 is drawn as indicated by the arrow 37 in FIG. 2 whereby less force will be required to hold the bowstring 20 in a fully drawn position than to hold the bowstring 20 at an intermediate drawn position, etc., as will now be apparent to those skilled in the art. The specific construction, arrangement, and operation of the archery bow 13 may vary as will be apparent to those skilled in the art and forms no part of the present invention. More specifically, for proper operation of the present invention, it is necessary only that the archery bow 13 includes a pulley, wheel, cam, etc., that rotates in response to the drawing of the bowstring 20 and by an amount proportional to the distance the bowstring 20 is drawn. Choice as to which of the standard pulleys, etc., to use in combination with the sensor 11 of the present invention is unimportant. However, for clarity and as a matter of convenience, the upper cam means 21 will be used in the following description of the preferred embodiment of sensor 11 of the present invention.

The sensor 11 of the present invention includes switch means 39 for being closed by the cam means in response to the drawing of the bowstring 20, i.e., for being closed by the rotation of a pulley, wheel, cam, etc., that rotates in response to the drawing of the bowstring 20. Thus, for example, the switch means 39 may be associated with the upper cam means 21 as clearly shown in FIGS. 1–3 and 5–10 for being closed when the upper cam means 21 rotates a predetermined amount in response to the drawing of the bowstring 20. The switch means 39 preferably includes a first contact member 41, a second contact member 43, and an electrically conductive plate member 45 attached to the body 31 of the cam means 21 for rotation therewith and for closing an electrical circuit between the first and second contact members 41, 43 when both contact members 41, 43 simultaneously contact the plate member 45. The location of the plate member 45 on the body 31 of the cam means 21 can preferably be varied and adjusted by a lock screw 47 or the like for reasons which will hereinafter become apparent. The contact members 41, 43 are preferably mounted on the upper limb 17 by a switch housing 49 or the like in a position so as to contact the plate member 45 when the cam means 21 rotates a predetermined amount in response to the drawing of the bowstring 20.

The sensor 11 includes light means 51 for emitting light when electrically energized and activated. The light means 51 may include a typical, off-the-shelf light emitting diode and preferably includes a typical light emitting sight pin for use with a typical bow sight frame for being fixedly attached to the handle section 15 of the archery bow 13 as will now be apparent to those skilled in the art. Such light emitting sight pins are well known to those skilled in the art and include a threaded body for being adjustably mounted in a vertical slot of the typical bow sight frame by a pair of opposing nuts or the like as will now be apparent to those skilled in the art.

The sensor 11 includes an electrical energy source 53 for electrically energizing and activating the light means 51 when the switch means 39 is closed. The electrical energy source 53 preferably consists of an extremely light and small off-the-shelf direct current battery of sufficient power to energize and activate the light means 51 as will now be apparent to those skilled in the art.

The light means 51 and electrical energy source 53 are preferably mounted to the handle section 15 of the archery bow 13 by a light housing 55 or the like in a position so the light emitted by the light means 51 will be readily viewed by the archer as the archer is drawing the bowstring 20.

Figure 4:
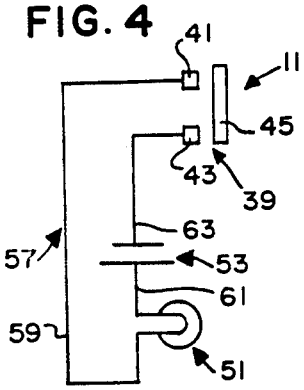
FIG. 4 is a somewhat diagrammatic electrical schematic of the electrical components of the first embodiment of the sensor of the present invention.
Figure 5:
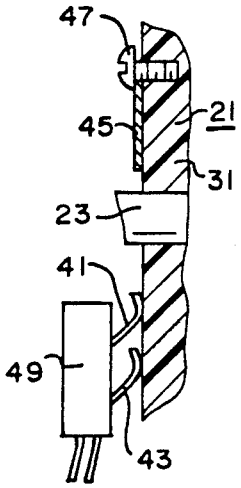
FIG. 5 is an enlarged sectional view of a portion of FIG. 1.
Figure 6:
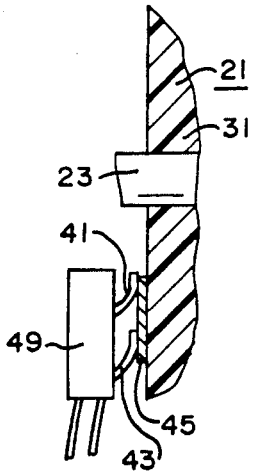
FIG. 6 is an enlarged sectional view of a portion of FIG. 2.
Figure 7:
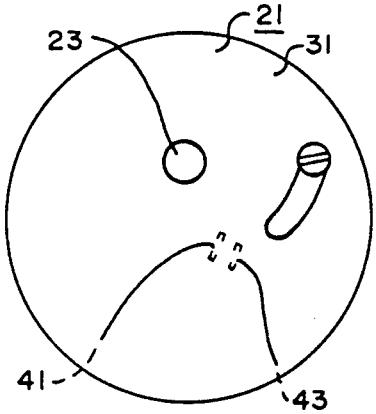
FIG. 7 is a side elevational view of a pulley of a compound bow with portions of the first embodiment of the sensor of the present invention attached thereto and with certain features of the first embodiment of the sensor of the present invention shown in broken lines.
Figure 8:
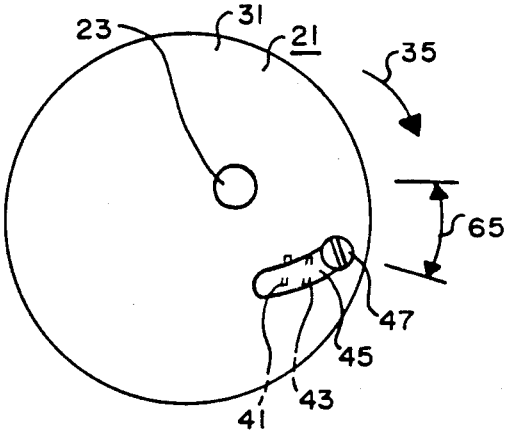
FIG. 8 is a side elevational view similar to FIG. 7 but with the pulley shown in a moved position.

The sensor 11 includes circuit means 57 for electrically connecting the first and second contact members 41, 41 to the light means 51 and the electrical energy source 53 in such a manner that the light means 51 will be electrically energized and activated to emit light when both contact members 41, 43 simultaneously contact the plate member 45. The circuit means 57 may include a first electrical conductor 59 for extending between the first contact member 41 and one terminal of the light means 51, a second electrical conductor 61 for extending between the other terminal of the light means 51 and one terminal of the electrical energy source 53, and a third electrical conductor 63 for extending between the other terminal of the electrical energy source 53 and the second contact member 43 as shown in FIG. 4. The electrical conductors 59, 61, 63 may consist of flexible electrically conductive wires or the like.

Figure 9:
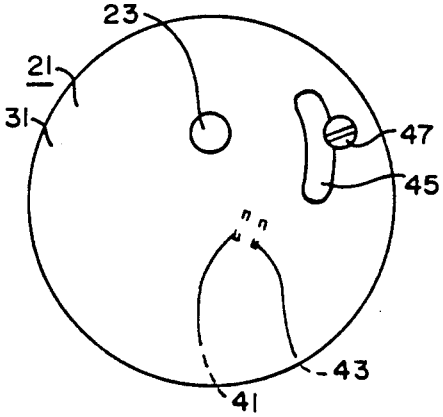
FIG. 9 is a side elevational view similar to FIG. 7 but with portions of the first embodiment of the sensor of the present invention shown in a moved position.
Figure 10:
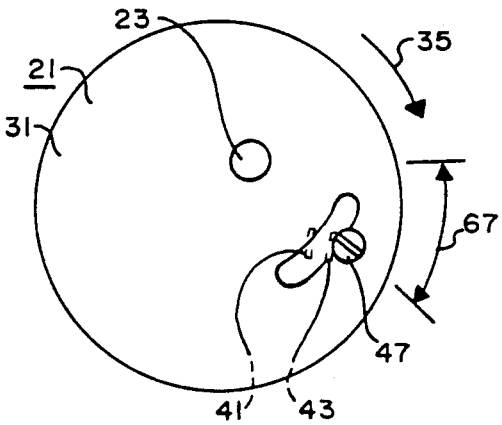
FIG. 10 is a side elevational view similar to FIG. 9 but with the pulley shown in a moved position.

An important feature of the sensor 11 of the present invention is the adjustability thereof. More specifically, by merely changing the position of the plate member 45 on the cam means 21, the distance the bowstring 20 must be drawn before the light means 51 is activated can be varied. Thus, as shown diagrammatically in FIGS. 7 and 8 with the relative contact areas of the contact members 41, 43 shown diagrammatically in broken lines, with the plate member 45 locked in a first position, the bowstring 20 must be drawn a sufficient distance so as to cause the cam means 21 to rotate a first distance as indicated by the arrow 65 on FIG. 8 before the switch means 39 is closed. However, by merely loosening the lock screw 47, moving the plate member 45 to a second position as shown in FIGS. 9 and 10, the bowstring 33 must be drawn a greater distance so as to cause the cam means 21 to rotate a greater second distance as indicated by the arrow 67 in FIG. 10 before the switch means 39 is closed.

It should be noted that the switch means 39 will remain closed only as long as both contact members 41, 43 simultaneously contact the plate member 45. Thus, if the bowstring 20 is "overdrawn" (i.e., drawn past the predetermined optimum), the plate member 45 will rotate past one or both contacts, causing the switch means 39 to open and the light means 51 to deactivate. The amount of "play" or "leadway" which the sensor 11 provides (i.e., the amount of movement of the bowstring 20 allowed around the "optimum draw" while keeping the switch means 39 closed) depends on the size and placement of the plate member 45. More specifically, by making the width of the plate member 45 greater at the point where the contact members 41, 43 cross the plate member 45 or arranging the plate member 45 on the cam means 21 so that the effective width thereof is increased, the switch means 39 will provide greater "play" as will now be apparent to those skilled in the art. On the other hand, by making the width of the plate member 45 smaller at the point where the contact members 41, 43 cross the plate member 45 or arranging the plate member 45 on the cam means 21 so that the effective width thereof is reduced, the switch means 39 will provide less "play" as will now be apparent to those skilled in the art.

A second preferred embodiment of the sensor of the present invention is shown in FIGS. 11–14 and identified by the numeral 2.11. The sensor 2.11 is for use with any typical compound archery bow 2.13 or the like.

The compound archery bow 2.13 may be identical to the compound archery bow 13 described above with reference to the sensor 11 and the above description of the archery bow 13 should be referred to for a more complete understanding thereof. Elements of the bow 2.13 shown in FIGS. 11 and 12 will be identified with the same reference numerals as the like elements of the bow 13.

The sensor 2.11 of the present invention includes switch means 2.39 for being closed by the cam means in response to the drawing of the bowstring 20, i.e., for being closed by the rotation of a pulley, wheel, cam, etc., that rotates in response to the drawing of the bowstring 20. Thus, for example, the switch means 2.39 may be associated with the upper cam means 21 as clearly shown in FIGS. 11 and 12 for being closed when the upper cam means 21 rotates a predetermined amount in response to the drawing of the bowstring 20. The switch means 2.39 preferably includes a normally opened switch member 2.40 and a contact member 2.42 for selectively causing the switch member 2.40 to close. The switch member 2.40 preferably includes a button or plunger 2.44 which will move the switch member 2.40 from an opened position as shown in FIG. 13 to a closed position as shown in FIG. 14 when pressure is applied to the plunger 2.44 to depress the plunger 2.44, etc. The switch member 2.40 is preferably constructed so that it will remain in the closed position only as long as pressure is applied to the plunger 2.44 and will move back to the opened position as soon as the plunger 2.44 is released. The switch member 2.40 is preferably dustproof and waterproof. The switch member 2.40 preferably consists of a typical, off-the-shelf button or plunger switch such as, for example, a type DHIC–BIAA ultra miniature DH series button switch manufactured by Cherry Electronics Products, 3625 Sunset Avenue, Waukegan, Illinois 60087. The contact member 2.42 is preferably attached to the body 31 of the cam means 21 for rotation therewith and for closing the switch member 2.40 when the cam means 21 rotates a predetermined amount in response to the drawing of the bowstring 20. The contact member 2.42 thus contacts and depresses the plunger 2.44 of the switch member 2.40 when the cam means 21 rotates the predetermined amount. The location of the contact member 2.42 on the body 31 of the cam means 21, the size of the contact member 2.42, and the shape of the contact member 2.42 determines when and how long the switch member 2.40 will be closed as will now be apparent to those skilled in the art. It should be noted that contact member 2.42 can be attached to the body 31 of the cam means 21 in various different manners as will now be apparent to those skilled in the art. For example, the contact member 2.42 can be permanently attached to the body member 31 by glue or the like, can be constructed as an integral, one-piece unit with the body member 31. However, the contact member 2.42 is preferably adjustably attached to the body member 31 to allow the location of the contact member 2.42 on the body member 31 to be varied and adjusted for reasons which will hereinafter become apparent. Thus, for example, a lock screw 2.47 or the like may be provided to adjustably secure the contact member 2.42 to the body member 31. The switch member 2.40 is preferably mounted on the upper limb 17 by screws or the like (not shown) in a position so that the plunger 2.44 will be contacted by the contact member 2.42 when the cam means 21 rotates a predetermined amount in response to the drawing of the bowstring 20.

The sensor 2.11 includes light means 2.51 for emitting light when electrically energized and activated. The light means 2.51 may consist of a typical, off-the-shelf light emitting diode. The light means 2.51 preferably consists of a typical light emitting sight pin 2.52 for use with a typical bow sight frame 2.52' for being fixedly attached to the handle section 15 of the archery bow 13 as will now be apparent to those skilled in the art. Such light emitting sight pins 2.52 are well known to those skilled in the art and include a threaded body for being adjustably mounted in a vertical slot of the typical bow sight frame 2.52' by a pair of opposing nuts or the like as will now be apparent to those skilled in the art.

The sensor 2.11 includes an electrical energy source 2.53 for electrically energizing and activating the light means 2.51 when the switch means 2.39 is closed. The electrical energy source 2.53 preferably consists of an extremely light and small off-the-shelf direct current battery of sufficient power to energize and activate the light means 2.51 as will now be apparent to those skilled in the art. The electrical energy source 2.53 may be housed within the base end of the lighted sight pin 2.52 as indicated in FIG. 12 and as will now be apparent to those skilled in the art.

The sensor 2.11 includes circuit means 2.57 for electrically connecting the switch member 2.40 to the light means 2.51 and the electrical energy source 2.53 in such a manner that the light means 2.51 will be electrically energized and activated to emit light when pressure is applied to the plunger 2.44 by the contact member 2.42. The circuit means 2.57 may include a first electrical conductor 2.59 for extending between the one terminal of the switch member 2.40 and one terminal of the light means 2.51, a second electrical conductor 2.61 for extending between the other terminal of the light means 2.51 and one terminal of the electrical energy source 2.53, and a third electrical conductor 2.63 for extending between the other terminal of the electrical energy source 2.53 and the other terminal of the switch member 2.40 as shown in FIG. 13. The electrical conductors 2.59, 2.61, 2.63 may consist of flexible electrically conductive wires or the like as will now be apparent to those skilled in the art.

An important feature of the sensor 2.11 of the present invention is the adjustability thereof. More specifically, by merely changing the position of the contact member 2.42 on the cam means 21, the distance the bowstring 20 must be drawn before the light means 2.51 is activated can be varied. Thus, by moving the position of the contact member 2.42 on the cam means 21, the distance the bowstring 13 must be drawn before the switch member 2.40 is closed can be varied as will now be apparent to those skilled in the art.

It should be noted that the switch member 2.40 will remain closed only as long as the contact member 2.42 is in actual physical contact with the plunger 2.44 of the switch member 2.40. Thus, if the bowstring 20 is "overdrawn" (i.e., drawn past the predetermined optimum), the contact member 2.42 will rotate past the plunger 2.44, causing the switch member 2.40 to open and the light means 2.51 to deactivate. The amount of "play" or "leadway" which the sensor 2.11 provides (i.e., the amount of movement of the bowstring 20 allowed around the "optimum draw" while keeping the switch member 2.40 closed) depends on the size and placement of the contact member 2.42. More specifically, by making the width of the contact member 2.4 greater at the point where the plunger 2.44 crosses the contact member 2.42 or arranging the contact member 2.42 on the cam means 21 so that the effective width thereof is increased, the switch means 2.39 will provide greater "play" as will now be apparent to those skilled in the art. On the other hand, by making the width of the contact member 2.42 smaller at the point where the plunger 2.44 crosses the contact member 2.42 or arranging the contact member 2.42 on the cam means 21 so that the effective width thereof is reduced, the switch means 2.39 will provide less "play" as will now be apparent to those skilled in the art.

Although the present invention has been described and illustrated with respect to preferred embodiments and preferred uses therefor, it is not to be so limited since modifications and changes can be made therein which are within the full intended scope of the invention.

We claim:

1. A sensor for use with a compound archery bow of the type including a body, a bowstring for being drawn by an archer, and cam means for connecting said bowstring to said body; said cam means including a body for being rotated when said bowstring is drawn; said sensor comprising:

a) switch means for being closed by said cam means in response to the drawing of said bowstring; said switch means including a first contact member, a second contact member, and an electrically conductive plate member attached to said body of said cam means for rotation with said cam means and for closing an electrical circuit between said first and second contact members when both of said first and second contact members simultaneously contact said electrically conductive plate member;

b) light means for emitting light when electrically energized and activated; and c) electrical energy source for electrically energizing and activating said light means when said switch means is closed.

2. The sensor of claim 1 in which the location of said electrically conductive plate member of said switch means on said body of said cam means can be varied.

3. The sensor of claim 1 in which said switch means includes a switch housing for mounting said first and second contact members to said body of said archery bow in a position so as to contact said electrically conductive plate member when said cam means rotates a predetermined amount in response to the drawing of the bowstring.

4. The sensor of claim 3 in which said light means is mounted to said body of said archery bow in a position so that any light emitted by said light means will be readily viewed by the archer as the bowstring is drawn.

5. The sensor of claim 4 in which said light means includes a light emitting diode.

6. The sensor of claim 5 in which said electrical energy source includes a direct current battery.

7. The sensor of claim 5 in which is included circuit means for electrically connecting said first and second contact members of said switch means to said battery of said electrical energy source and said light emitting diode of said light means in such a manner that said light emitting diode of said light means will be electrically energized and activated to emit light when both of said first and second contact members of said switch means simultaneously contact said electrically conductive plate member.

8. The sensor of claim 7 in which said circuit means includes electrically conductive wires extending between said first and second contact members of said switch means and said light emitting diode of said light means, and said battery of said electrical energy source.

9. A sensor for use with a compound archery bow of the type including a body, a bowstring for being drawn by an archer, and cam means for connecting said bowstring to said body, said cam means including a body for being rotated when the bowstring is drawn; said sensor comprising:

a) switch means for being closed by said cam means in response to the drawing of said bowstring; said switch means including a first contact member, a second contact member, and an electrically conductive plate member attached to said body of said cam means for rotation with said cam means and for closing an electrical circuit between said first and second contact members when both of said first and second contact members simultaneously contact said electrically conductive plate member; the location of said electrically conductive plate member of said switch means on said body of said cam means being adjustable;

b) light means for emitting light when electrically energized and activated; and c) electrical energy source for electrically energizing and activating said light means when said switch means is closed.

10. A sensor for use with a compound archery bow of the type including a body, a bowstring for being drawn by an archer, and cam means for connecting said bowstring to said body; said cam means including a body for being rotated when said bowstring is drawn; said sensor comprising:

a) switch means for being closed by said cam means in response to the drawing of said bowstring; said switch means including a normally opened switch member; said switch means including a contact member attached to said body of said cam means for rotation with said cam means and for contacting said switch member and closing said switch member when said body of said cam means has rotated a predetermined amount in response to the drawing of said bowstring;

b) light means for emitting light when electrically energized and activated; and c) electrical energy source for electrically energizing and activating said light means when said switch means is closed.

11. The sensor of claim 10 in which the location of said contact member of said switch means on said body of said cam means can be varied.

12. The sensor of claim 10 in which said switch member includes a plunger and is mounted to said body of said archery bow in a position so that said plunger will be depressed by said contact member when said cam means rotates a predetermined amount in response to the drawing of the bowstring.

13. The sensor of claim 12 in which said light means is mounted to said body of said archery bow in a position so that any light emitted by said light means will be readily viewed by the archer as the bowstring is drawn.

14. The sensor of claim 13 in which said light means includes a light emitting diode.

15. The sensor of claim 14 in which said electrical energy source includes a direct current battery.

16. The sensor of claim 15 in which is included circuit means for electrically connecting said switch member of said switch means to said battery of said electrical energy source and to said light emitting diode of said light means in such a manner that said light emitting diode of said light means will be electrically energized and activated to emit light when said plunger of said switch member is depressed by said contact member.

17. The sensor of claim 16 in which said circuit means includes electrically conductive wires extending between said switch member, said light emitting diode of said light means, and said battery of said electrical energy source.

18. A sensor for use with a compound archery bow of the type including a body, a bowstring for being drawn by an archer, and cam means for connecting said bowstring to said body, said cam means including a body for being rotated when the bowstring is drawn; said sensor comprising:

a) switch means for being closed by said cam means in response to the drawing of said bowstring; said switch means including a normally opened switch member having a plunger for being depressed to close said switch member; said switch member including a contact member attached to said body of said cam means for rotation with said cam means and for depressing said plunger of said switch member when said body of said cam means has rotated a predetermined amount in response to the drawing of said bowstring; the location of said contact member of said switch means on said body of said cam means being adjustable;

b) light means for emitting light when electrically energized and activated; and c) electrical energy source for electrically energizing and activating said light means when said switch means is closed.

* * * * *